US006029039A

United States Patent [19]

Aslam et al.

[11] Patent Number: 6,029,039

[45] Date of Patent: Feb. 22, 2000

[54] RETRACTABLE CONTACT SKIVE ASSEMBLY FOR REPRODUCTION APPARATUS FUSER ROLLERS

[75] Inventors: Muhammed Aslam, Rochester; Tsutumu Miura, Pittsford, both of N.Y.

[73] Assignee: Eastman Kodak Company, Rochester, N.Y.

[21] Appl. No.: 09/197,259

[22] Filed: Nov. 20, 1998

[51] Int. Cl.[7] ..... G03G 15/20; B65H 29/54

[52] U.S. Cl. ..... 399/323; 271/307

[58] Field of Search ..... 271/307, 308, 271/311; 399/320, 322, 323, 397, 398, 399, 21, 22

[56] References Cited

U.S. PATENT DOCUMENTS 4,408,757 10/1983 Yarm ..... 271/311
5,532,810 7/1996 Cahill ..... 399/323

*Primary Examiner*—Arthur T. Grimley
*Assistant Examiner*—Hoang Ngo
*Attorney, Agent, or Firm*—Lawrence P. Kessler

[57] ABSTRACT

A fuser apparatus having a pair of rollers in nip relation to transport a receiver member therebetween to permanently fix a marking particle image to such receiver member, and a retractable contact skive assembly for stripping a receiver member adhering to a fuser apparatus roller from said roller. The retractable contact skive assembly includes a plurality of skive fingers. A resilient member urges the skive fingers in a direction into operative relation with a roller of the pair of rollers to strip a receiver member therefrom. The resilient member is selected to exert a force on the skive fingers less than the force exerted thereon by a jammed receiver member. A retractor guide plate is engageable with the skive fingers when the skive fingers are moved by a jammed receiver member in a direction substantially opposite the direction of urging by the resilient member, and retracts the skive fingers out of contact with the fuser roller to prevent damage to the fuser roller by the skive fingers.

17 Claims, 3 Drawing Sheets

RETRACTABLE CONTACT SKIVE ASSEMBLY FOR REPRODUCTION APPARATUS FUSER ROLLERS

FIELD OF THE INVENTION

The present invention relates in general to a skive assembly for a fuser roller, and more particularly to a retractable contact skive which will substantially prevent skive finger gouging damage to the fuser roller.

BACKGROUND OF THE INVENTION

In typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction thereon.

One type of fuser apparatus, utilized in typical reproduction apparatus, includes at least one heated roller and at least one pressure roller in nip relation with the heated roller. The fuser apparatus rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member. It sometimes happens that the marking particles stick to the peripheral surface of the heated roller and result in the receiver member adhering to such roller; or the marking particles may stick to the heated roller and subsequently transfer to the peripheral surface of the pressure roller resulting in the receiver member adhering to the pressure roller. Therefore, a skive mechanism, including mechanical skive fingers (or separator pawls), has been employed to engage the respective peripheral surfaces of the fuser apparatus rollers to strip any adhering receiver member from the rollers in order to substantially prevent receiver member jams in the fuser apparatus. Typically a fuser apparatus skive mechanism includes a plurality of skive fingers. The skive fingers are generally formed as elongated members respectively having a relatively sharp leading edge urged into engagement with a fuser apparatus roller. For example, the skive fingers may be thin, relatively flexible, metal shim stock. The respective leading edge of each of the skive fingers is directed, in the opposite direction to rotation of the fuser apparatus roller with which such skive finger is associated, so as to act like a chisel to strip any receiver member adhering to such roller from the peripheral surface thereof.

However, if the marking particle image is particularly heavy, the receiver member may adhere to a fuser apparatus roller with such force that engagement with the skive fingers does not completely strip the receiver member from the roller. When a receiver member transported through the fuser apparatus is only stripped from a roller by some of the skive fingers (and not by others), the receiver member will cause a jam in the fuser apparatus. This destroys the reproduction formed on the receiver member and shuts down the reproduction apparatus. Moreover, as the receiver member moves with the fuser apparatus roller to which it adheres, the stripped portions of the receiver member are forced into engagement with their associated skive fingers by the non-stripped portions of the receiver member. The engagement force of the receiver member on the skive fingers may be sufficient to flex those skive fingers so as to engage the associated peripheral surface of the fuser apparatus roller at a substantially increased attack angle. This increased attack angle may then damage the roller by gouging its peripheral surface or may damage the skive finger itself. Alternatively, as the receiver member is transported through the fuser apparatus, the receiver member may apply such force to the skive fingers on initial engagement therewith so as to cause such fingers to buckle in the direction which will flex those skive fingers to engage the associated fuser apparatus roller at an increased attack angle. Again, this increased attack angle may damage the roller by gouging its peripheral surface or may damage the skive finger itself.

SUMMARY OF THE INVENTION

In view of the above, this invention is directed to a fuser apparatus having a pair of rollers in nip relation to transport a receiver member therebetween to permanently fix a marking particle image to such receiver member, and a skive assembly having retractable contact skive fingers. The retractable contact skive assembly includes a plurality of skive fingers. A resilient member urges the skive fingers in a direction into operative relation with a roller of the pair of rollers to strip a receiver member therefrom. The resilient member is selected to exert a force on the skive fingers less than the force exerted thereon by a jammed receiver member. A retractor guide plate is engageable with the skive fingers when the skive fingers are moved by a jammed receiver member in a direction substantially opposite the direction of urging by the resilient member, and retracts the skive fingers out of contact with the fuser roller to prevent damage to the fuser roller by the skive fingers.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
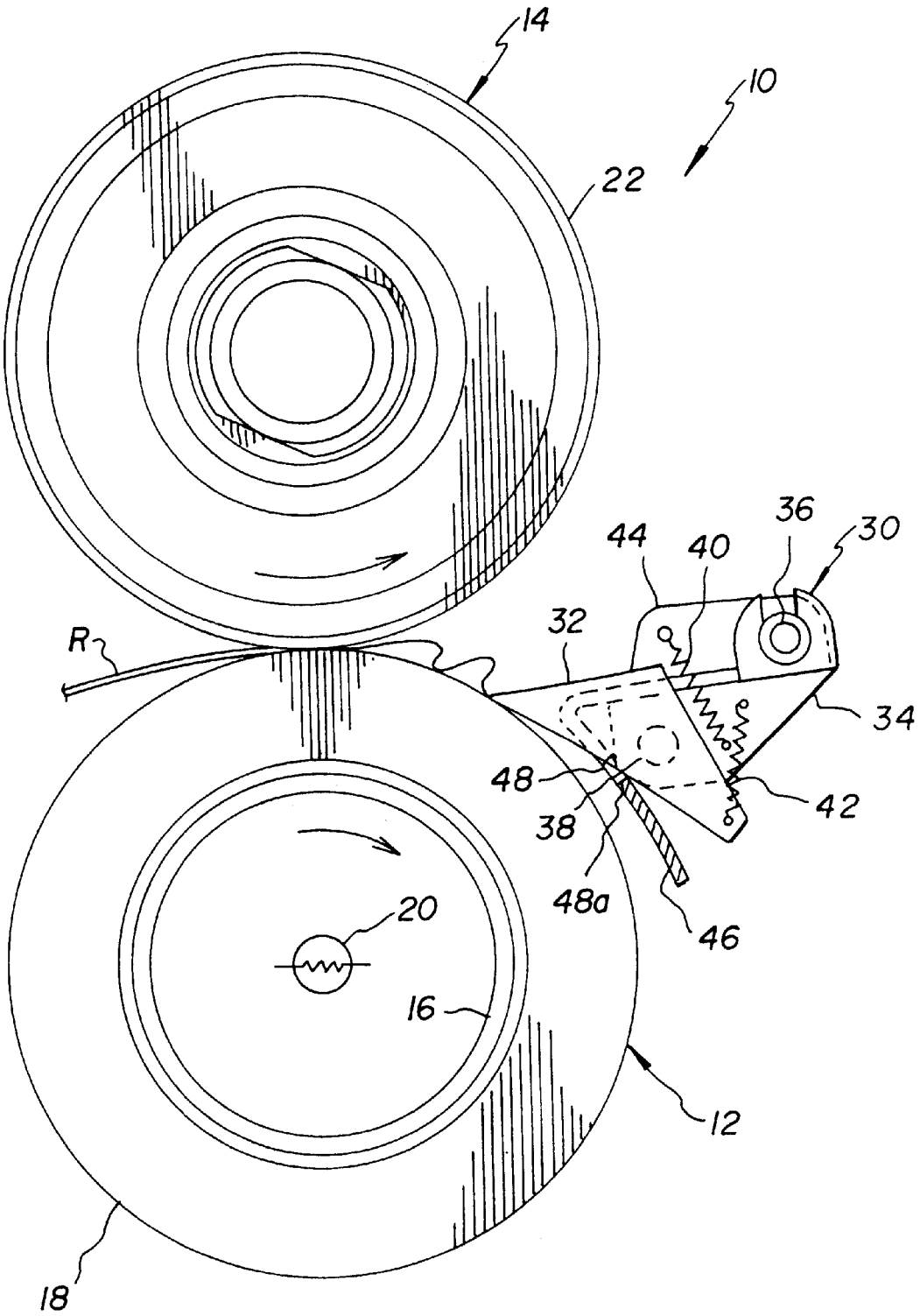
FIG. 1 is a side elevational view of a reproduction apparatus fuser having a skive assembly, with portions removed or broken away to facilitate viewing, with retractable contact skive fingers, according to this invention, shown in operative relation with the fuser roller.
Figure 2:
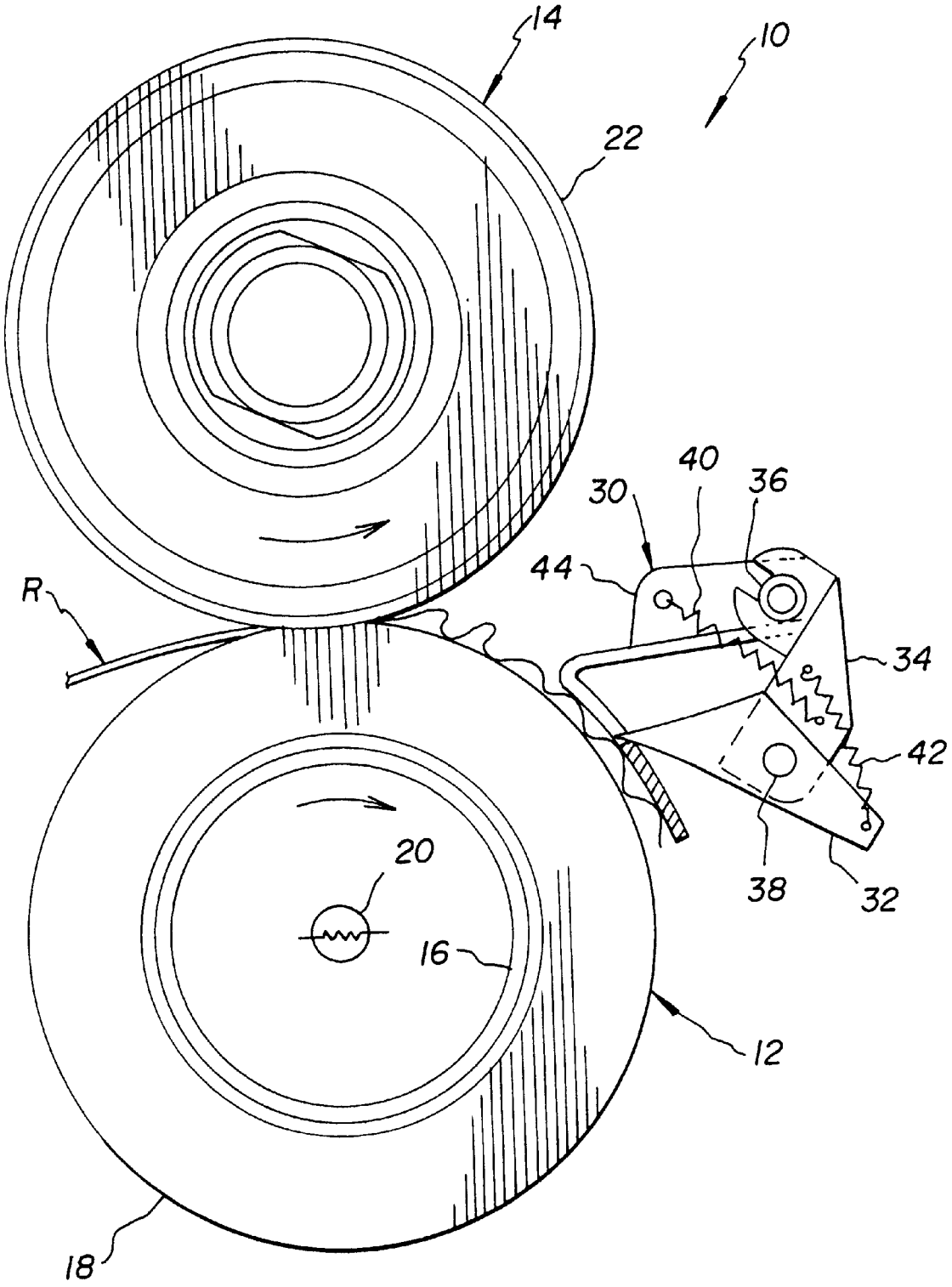
FIG. 2 is a side elevational view of a reproduction apparatus fuser having a skive assembly, with portions removed or broken away to facilitate viewing, similar to FIG. 1, with retractable contact skive fingers, according to this invention, shown in a retracted position relative to the fuser roller.

Referring now to the accompanying drawings, FIGS. 1 and 2 show a typical fuser, designated generally by the numeral 10, for a reproduction apparatus. The fuser apparatus 10 includes a fuser roller 12 in nip relation with a pressure roller 14. Rotation of the fuser apparatus rollers by any suitable drive mechanism (not shown) will serve to transport a receiver member (designated by the letter R in FIG. 1), bearing a marking particle image through the nip under the application of heat and pressure. The receiver member may be, for example, a sheet of plain bond paper, or transparency material. The heat will soften the marking particles and the pressure will force the particles into intimate contact and to be at least partially imbibed into the fibers at the surface of the receiver material. Thus, when the marking particles cool, they are permanently fixed to the receiver member in an image-wise fashion.

The fuser roller 12 includes a core 16 and a cylindrical fusing blanket 18 supported on the core. The blanket 18 is typically made of a rubber material particularly formulated to be heat conductive or heat insulative dependent upon whether the fuser heat source is located within the core 16 or in juxtaposition with the periphery of the blanket. In the illustrated preferred embodiment as shown in FIG. 1, the heat source is an internal heater lamp designated by the numeral 20. A well known suitable surface coating (not shown) may be applied to the blanket 18 to substantially prevent offsetting of the marking particle image to the fuser roller 12.

The pressure roller 14 has a hard outer shell 22. Typically, the shell 22 is made of metal, such as aluminum or steel for example. The shell 22 may also have a well known suitable surface coating (not shown) applied thereto to substantially prevent offsetting of the marking particle image to the pressure roller 14. A cleaning assembly (not shown) may be provided to remove residual marking particle, paper fibers, and dust from the fuser apparatus rollers.

Figure 3:
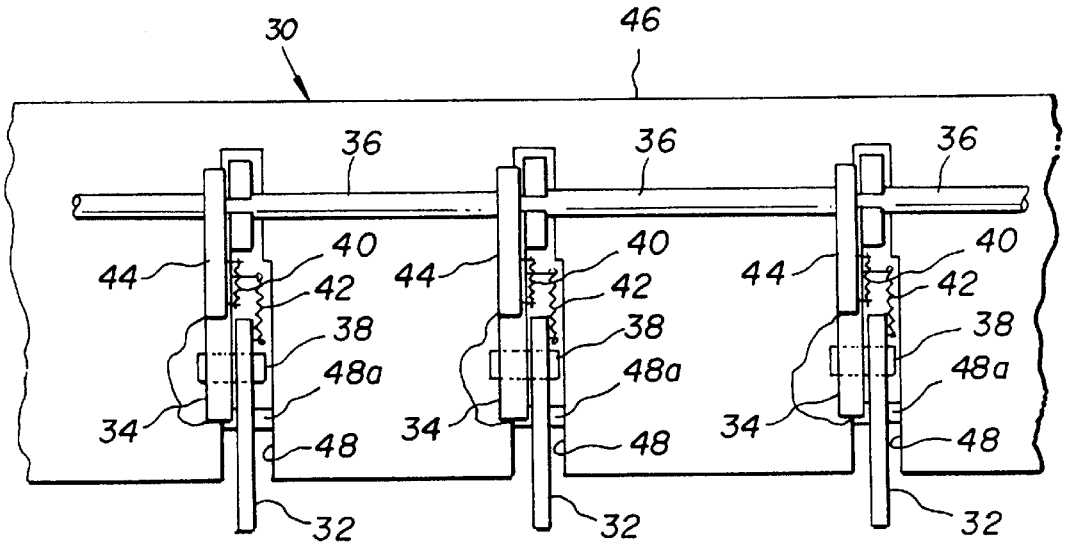
FIG. 3 is a top plan view of a portion of the skive assembly, with retractable contact skive fingers, according to this invention, as shown in FIG. 1, with portions removed or broken away to facilitate viewing.
Figure 4:
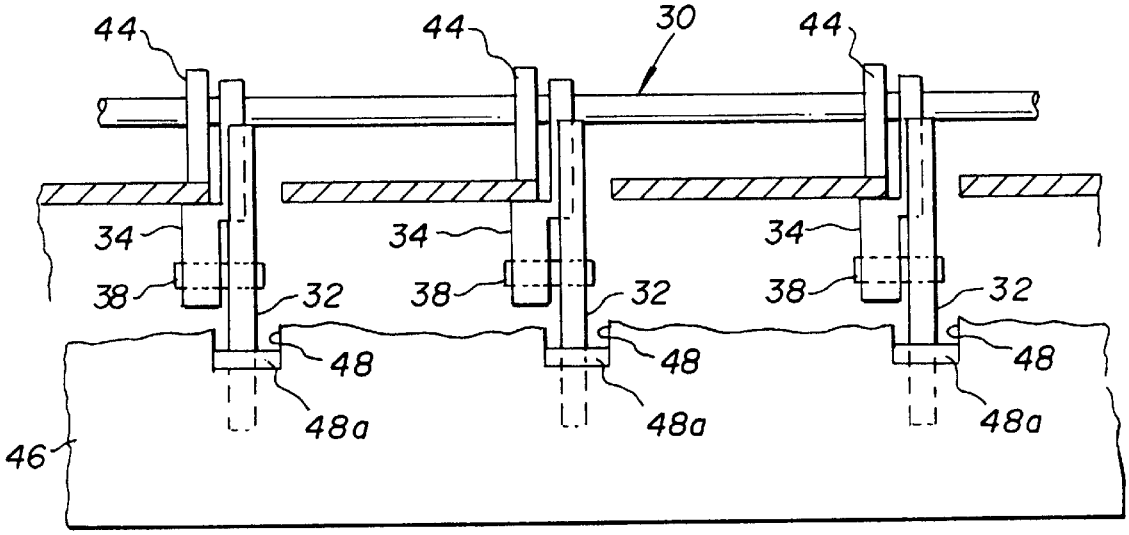
FIG. 4 is a front elevational view of a portion of the skive assembly, with retractable contact skive fingers, according to this invention, as shown in FIG. 1, with portions removed or broken away to facilitate viewing.

As noted above, under certain circumstances, such as when fusing heavy marking particle images, the receiver member may adhere to one or the other of the fuser apparatus rollers (i.e., fuser roller 12 or pressure roller 14). Therefore, a skive assembly, designated generally by the numeral 30, is provided having retractable contact skive fingers, according to the invention. The skive assembly 30 includes a plurality of mechanical contact skive fingers 32 (see FIGS. 3 and 4). The skive fingers are spaced apart any suitable distance, over the length of the fuser roller 12, along an element parallel to an element of the fuser roller. Each of the skive fingers is mounted on a respective support arm 34, which is in turn, supported by a rod 36. The rod 36 is mounted in a plurality of brackets 44 located at fixed predetermined positions relative to the fuser assembly 10. The skive fingers 32 are respectively supported by the support arms 34, for example on a pivot pins 38, in a manner which enables the skive fingers to respectively pivot about the longitudinal axes of the pivot pins. Similarly, the support arms 34 are respectively supported by the rod 36 in a manner which enables the brackets to respectively pivot about the longitudinal axes of the rod. A retractor guide plate 46 is connected to the brackets 44. The retractor guide plate 46 has a plurality of slots 48 for receiving the plurality of skive fingers 32 respectively. The slots 48 respectively define a lip 48a which serve to guide the movement of the skive fingers as described below.

Resilient members, such as tension springs 40 and 42, are provided to urge the skive fingers 32 in a direction into operative relation with the fuser roller 12 (as shown in FIG. 1). The spring 40 is coupled between the bracket 44 and the support arm 34. The spring 42 is coupled between the support arm 34 and a finger 32. The springs 40 urge the support arms 34 about the rod 36 to the location where the respective lead edge of the brackets engages the underside of the retractor guide plate 46. At the same time, the springs 42 urge the skive fingers 32 in a direction about the respective pivot pins 38 into contact with the fuser roller 12. By the predetermined location of the retractor guide plate relative to the fuser apparatus 10, and the limiting of the rotation of the support arms 34 thereby, the contact points for the respective skive fingers 32 with the fuser roller 12 are at the optimum location for effective stripping receiver members from the fuser roller.

As discussed, under certain conditions, a receiver member may adhere to the fuser roller 12 with such force that it is prevented from being stripped by the skive fingers. However, the retractable contact skive assembly 30, according to this invention, will prevent damage to the fuser roller when such condition occurs; that is, when the receiver member jams, but prior to such jamming causing damage to the fuser roller by gouging of the fuser roller surface by the skive fingers. The spring constants for the springs 40 and 42 are selected to provide respective urging forces which are less than the forces generated by a jammed receiver member acting on the skive fingers 32. Accordingly, the skive fingers will retract (against the urging of the springs 40 and 42) out of contact with the fuser roller 12. The skive fingers 32 will move respective support arms 34 about the rod 36 so that the lead edges disengage the underside of the retractor guide plate 46. The lips 48a of the slots 48 in the retractor guide plate guide the fingers as they move under the urging of the jammed receiver member so as to respectively retract the skive fingers from contact with the fuser roller 12 (see FIG. 2). As such, gouging damage to the fuser roller by the skive fingers is prevented.

The invention has been described in detail with particular reference to certain preferred embodiments thereof, but it will be understood that variations and modifications can be effected within the spirit and scope of the invention.

What is claimed is:

1. A fuser apparatus having a pair of rollers in nip relation to transport a receiver member therebetween to permanently fix a marking particle image to such receiver member, and a retractable contact skive assembly for stripping a receiver member adhering to a fuser apparatus roller from said roller, said retractable contact skive assembly comprising:

a plurality of skive fingers;

a resilient member for urging said skive fingers in a direction into operative relation with a roller of said pair of rollers to strip a receiver member therefrom, said resilient member being selected to exert a force on said skive fingers less than the force exerted thereon by a jammed receiver member; and a retractor guide plate, said retractor guide plate engageable with said skive fingers when said skive fingers are moved by a jammed receiver member in a direction substantially opposite said direction of urging by said resilient member, and retracting said skive fingers out of contact with said fuser roller to prevent damage to said fuser roller by said skive fingers.

2. The retractable contact skive according to claim 1 wherein said plurality of skive fingers are pivotably connected to a plurality of support arms respectively.

3. The retractable contact skive according to claim 2 including a rod, a plurality of brackets supporting said rod, and said support arms being mounted on said rod for pivotable movement about said rod.

4. The retractable contact skive according to claim 3 wherein said resilient member includes a first spring coupled to a skive finger and said support arm associated therewith, and a second spring coupled to said support arm and an associated bracket supporting said rod.

5. The retractable contact skive according to claim 4 wherein said retractor guide plate includes a plurality of slots accommodating said plurality of skive fingers respectively.

6. The retractable contact skive according to claim 5 wherein said each of said slots of said retractor guide plate has a lip which acts to retract a respective skive finger moved by a jammed receiver member.

7. The retractable contact skive assembly according to claim 1 including a plurality of support arms, said plurality of skive fingers being pivotably connected to said plurality of support arms respectively; a rod, a plurality of brackets supporting said rod, and said support arms for said skive fingers being mounted on said rod for pivotable movement about said rod; said resilient member including a first spring coupled to a skive finger and said support arm associated therewith, and a second spring coupled to said support arm and an associated bracket supporting said rod; and said retractor guide plate including a plurality of slots accommodating said plurality of skive fingers respectively, said each of said slots of said retractor guide plate having a lip which acts to retract a respective skive finger moved by a jammed receiver member.

8. A fuser apparatus for a reproduction apparatus, said fuser apparatus comprising:

a heated fuser roller;

a pressure roller in nip relation with said heated fuser roller; and a skive mechanism including a plurality of skive fingers, a resilient member for urging said skive fingers in a direction into operative relation with a roller of said pair of rollers to strip a receiver member therefrom, said resilient member being selected to exert a force on said skive fingers less than the force exerted thereon by a jammed receiver member, and a retractor guide plate, said retractor guide plate engageable with said skive fingers when said skive fingers are moved by a jammed receiver member in a direction substantially opposite said direction of urging by said resilient member, and retracting said skive fingers out of contact with said roller to prevent damage to said roller by said skive fingers.

9. The fuser apparatus according to claim 8 including a plurality of support arms, said plurality of skive fingers being pivotably connected to said plurality of support arms respectively; and a rod, a plurality of brackets supporting said rod, said support arms for said skive fingers being mounted on said rod for pivotable movement about said rod.

10. The fuser apparatus according to claim 9 wherein said resilient member includes a first spring coupled to a skive finger and said support arm associated therewith, and a second spring coupled to said support arm and an associated bracket supporting said rod.

11. The fuser apparatus according to claim 10 wherein said retractor guide plate includes a plurality of slots accommodating said plurality of skive fingers respectively, each of said slots of said retractor guide plate having a lip which acts to retract a respective skive finger moved by a jammed receiver member.

12. The retractable contact skive assembly according to claim 8 including a plurality of support arms, said plurality of skive fingers being pivotably connected to said plurality of support arms respectively; a rod, a plurality of brackets supporting said rod, and said support arms for said skive fingers being mounted on said rod for pivotable movement about said rod; said resilient member including a first spring coupled to a skive finger and said support arm associated therewith, and a second spring coupled to said support arm and an associated bracket supporting said rod; and said retractor guide plate including a plurality of slots accommodating said plurality of skive fingers respectively, said each of said slots of said retractor guide plate having a lip which acts to retract a respective skive finger moved by a jammed receiver member.

13. A fuser apparatus for permanently fixing a marking particle image to such receiver member, and a retractable contact skive assembly for stripping a receiver member adhering to a fuser apparatus roller from said roller, said retractable contact skive assembly comprising:

a plurality of skive fingers;

a resilient member for urging said skive fingers in a direction into operative relation with said fuser apparatus to strip a receiver member therefrom, said resilient member being selected to exert a force on said skive fingers less than the force exerted thereon by a jammed receiver member; and a retractor guide plate, said retractor guide plate engageable with said skive fingers when said skive fingers are moved by a jammed receiver member in a direction substantially opposite said direction of urging by said resilient member, and retracting said skive fingers out of contact with said fuser apparatus to prevent damage to said fuser apparatus by said skive fingers.

14. The fuser apparatus according to claim 13 including a plurality of support arms, said plurality of skive fingers being pivotably connected to said plurality of support arms respectively; and a rod, a plurality of brackets supporting said rod, said support arms for said skive fingers being mounted on said rod for pivotable movement about said rod.

15. The fuser apparatus according to claim 14 wherein said resilient member includes a first spring coupled to a skive finger and said support arm associated therewith, and a second spring coupled to said support arm and an associated bracket supporting said rod.

16. The fuser apparatus according to claim 15 wherein said retractor guide plate includes a plurality of slots accommodating said plurality of skive fingers respectively, each of said slots of said retractor guide plate having a lip which acts to retract a respective skive finger moved by a jammed receiver member.

17. The retractable contact skive assembly according to claim 13 including a plurality of support arms, said plurality of skive fingers being pivotably connected to said plurality of support arms respectively; a rod, a plurality of brackets supporting said rod, and said support arms for said skive fingers being mounted on said rod for pivotable movement about said rod; said resilient member including a first spring coupled to a skive finger and said support arm associated therewith, and a second spring coupled to said support arm and an associated bracket supporting said rod; and said retractor guide plate including a plurality of slots accommodating said plurality of skive fingers respectively, said each of said slots of said retractor guide plate having a lip which acts to retract a respective skive finger moved by a jammed receiver member.

* * * * *